US006452125B1

(12) United States Patent
Yu

(10) Patent No.: US 6,452,125 B1
(45) Date of Patent: Sep. 17, 2002

(54) SWITCH WITH AN OVERRIDE INTERRUPTION STRUCTURE

(76) Inventor: Tsung-Mou Yu, No. 4, Alley 2, Lane 23, Sec. 3, Pa Te Road, PanChiao City, Taipei Hsien (TW)

( * ) Notice: Subject to any disclaimer, the term of this patent is extended or adjusted under 35 U.S.C. 154(b) by 0 days.

(21) Appl. No.: 09/810,899

(22) Filed: Mar. 17, 2001

(51) Int. Cl.[7] ..... H01H 21/01
(52) U.S. Cl. ..... 200/553; 200/339
(58) Field of Search ..... 200/553, 556, 200/562, 339

(56) References Cited

U.S. PATENT DOCUMENTS

| | | | | |
|---|---|---|---|---|
| 4,661,667 | A | | 4/1987 | Sorimachi |
| 4,704,594 | A | | 11/1987 | Krasser |
| 4,931,762 | A | | 6/1990 | Fierro |
| 4,937,548 | A | | 6/1990 | Sdunek |
| 5,182,538 | A | * | 1/1993 | Miiller ..... 337/102 |
| 5,223,813 | A | | 6/1993 | Cambreleng |
| 5,262,748 | A | | 11/1993 | Tsung-Mou |
| 5,451,729 | A | | 9/1995 | Onderka |
| 5,760,672 | A | | 6/1998 | Wang |
| 5,786,742 | A | | 7/1998 | Yin |
| 5,933,069 | A | | 8/1999 | Huang |

* cited by examiner

*Primary Examiner*—Elvin Enad
*Assistant Examiner*—Lisa N. Klaus

(57) ABSTRACT

A switch includes a box with a button pivotally connected there and two terminal plates extend through a bottom of the box. A positioning member has one end fixedly connected to the box and the other end formed with a protrusion. A link is connected to an end of the button and has an engaging port so as to engage with a first end of a bimetal plate. A second end of the bimetal plate is connected to one of the terminal plates. When current overrides, the first end of the bimetal plate pushes the link and the button and moves over the protrusion of the positioning member. The first end of the bimetal plate is stopped by the protrusion from moving back to its original position.

5 Claims, 4 Drawing Sheets

SWITCH WITH AN OVERRIDE INTERRUPTION STRUCTURE

FIELD OF THE INVENTION

The present invention relates to a switch that has a positioning member with a protrusion which positions one end of a bimetal plate at a close circuit position and an open circuit position.

BACKGROUND OF THE INVENTION

Switches generally have two functions, opening the circuit or closing the circuit, and either one is simply a push to a switch button to let the two contact points in the switch box separate from each other or contact with each other. However, in an overridden situation, the switches cannot react by themselves and the current could melt parts in the switches or the electric appliances to result in damage. A bimetal plate is used in the switch box to prevent the situation. Switches with an override interruption structure known to applicant are disclosed in U.S. Pat. No. 5,786,742, 5,223,813, 4,937,548, 4,661,667, 4,931,762, 5,451,729, 4,704,594 and 4,937,548. A thermally deformed bimetal plate is used to open the circuit when the current overrides. However, the action to open the circuit takes time because the structure is so complicated and the two contact points are indirectly operated by the bimetal plate so that there is a possibility for the electric current to destroy the electric equipment when the switch is overridden.

Besides, U.S. Pat. No. 5,933,069 and 5,262,748 each has a simple structure and employs one positioning member connected to an end of the switch button, the other positioning member connected to an inside of the switch box, and a spring connected between the two positioning members. However, it is difficult to assemble the three parts in the switch box and there is friction between the positioning member and the box so that it cannot react immediately if the bimetal plate is worn out. U.S. Pat. No. 5,760,672 provides a simple structure for the switch but the bimetal plate lacks a reliable positioning function to maintain its overridden position.

The present invention intends to provide a switch that has a simple structure and the bimetal plate is positioned when it is deformed.

The primary object of the present invention is to provide a switch that has a bimetal plate which is held at its position after it is deformed due to current overriding.

SUMMARY OF THE INVENTION

In accordance with one aspect of the present invention, there is provided a switch comprising a box and a button pivotally connected to a top of the box and two terminal plates respectively extending through a bottom of the box. A positioning member has a fist end fixedly connected to the box and a second end formed with a protrusion. A link has a first end connected to an end of the button and a second end formed with an engaging port. A bimetal plate has a first end fixedly connected to one of the terminal plates and a second end engaged with the engaging port of the link. The second end of the bimetal plate pushes the protrusion of the positioning member when it is moved.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
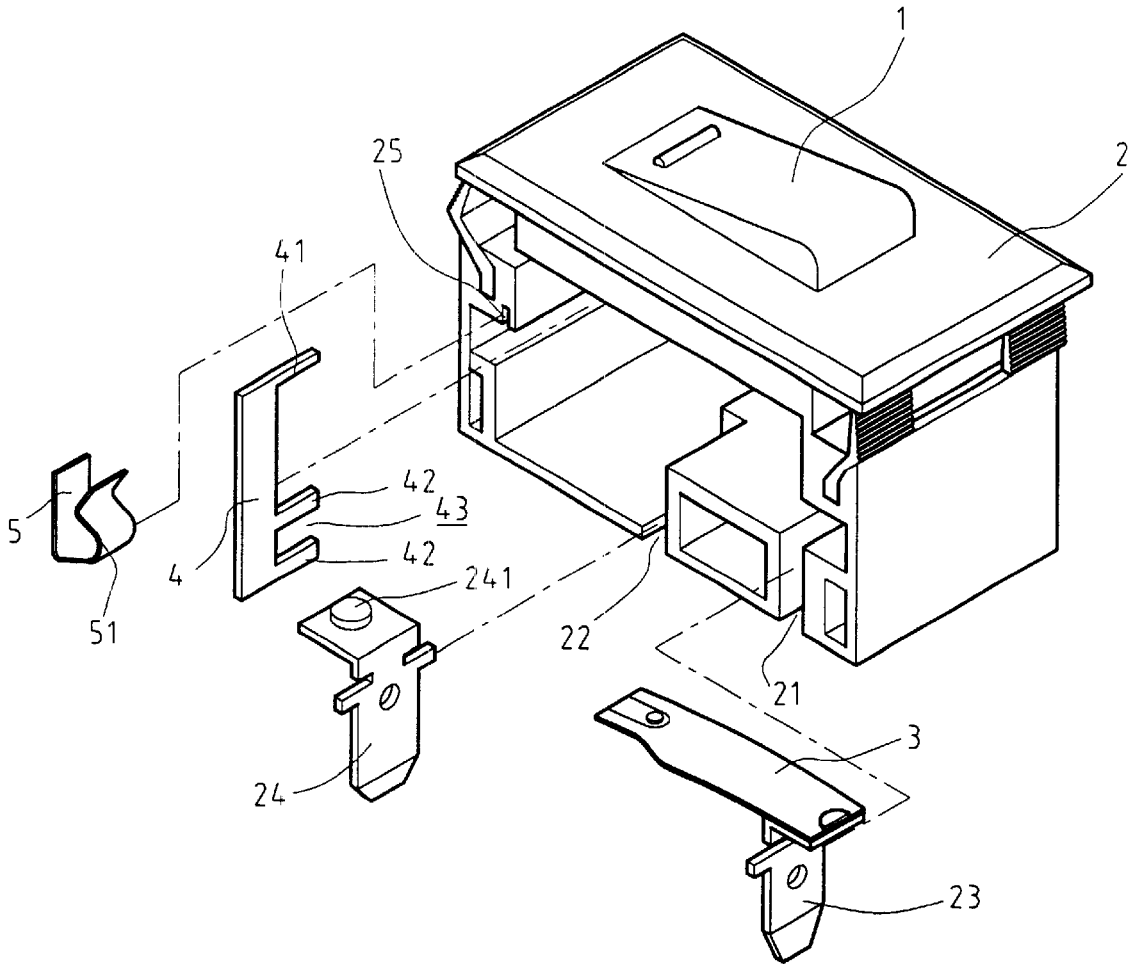
FIG. 1 is an exploded view to show a switch structure of the present invention.
Figure 2:
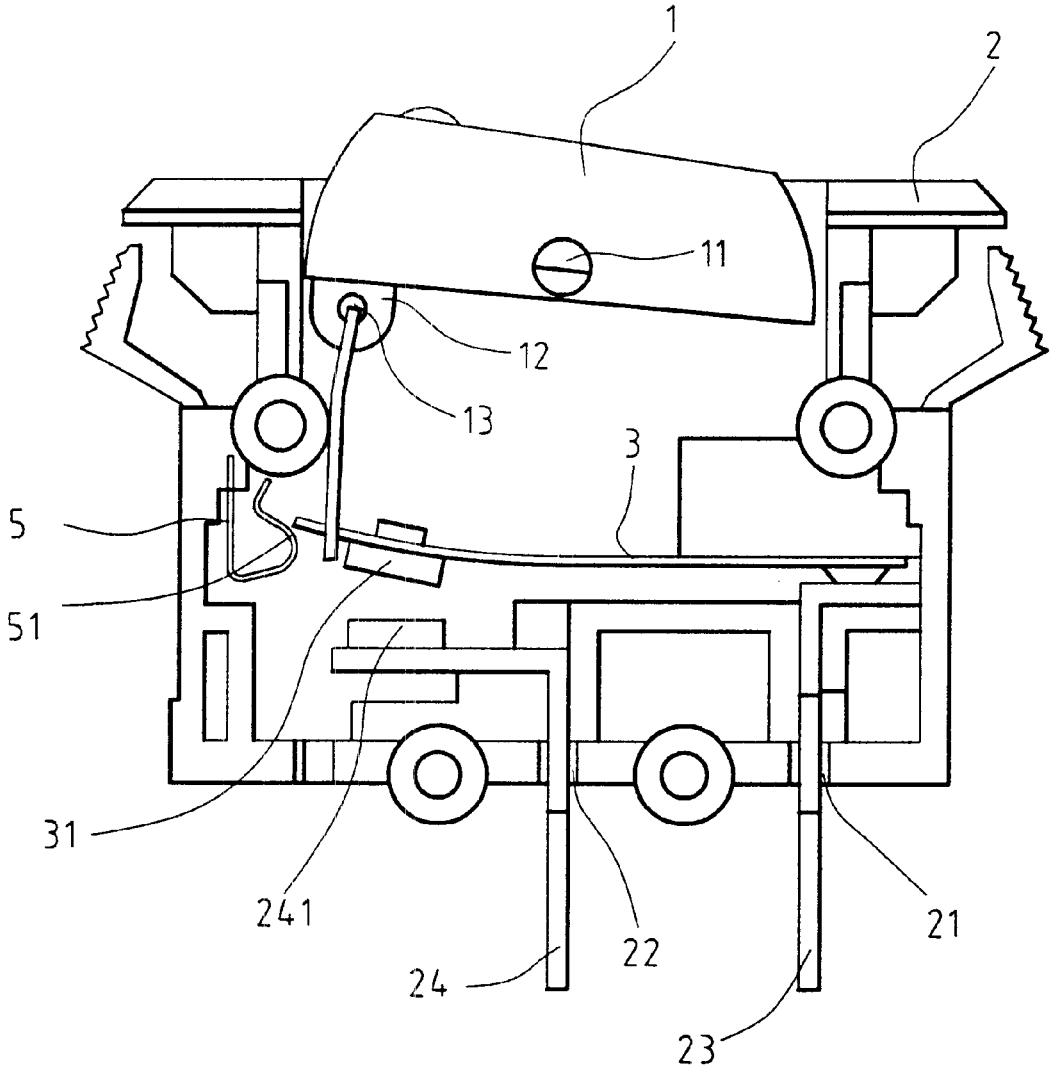
FIG. 2 is a side view to show the switch when the two contact points are separated.

Referring to FIGS. 1 and 2, the switch of the present invention comprises a box 2 and a button 1 pivotally connected to the top of the box 2 with a pin 11 being the fulcrum. A lug 12 extends from an end of the button 1. Two terminal plates 23, 24 respectively extend through two slots 21, 22 defined in the bottom of the box 2. The terminal plate 24 has a first contact point 241. A positioning member 5 is a U-shaped spring member and a first end of the positioning member 5 is fixedly engaged with an engaging slit 25 defined in the box 2. A second end of the positioning member 5 is a free end and has a protrusion 51. A gap is defined between the two ends of the positioning member 5.

A link 4 has a first end 41 inserted through a hole 13 defined in the lug 12 connected on the switch 1 and a second end having an engaging port 43 which is defined between two rods 42 extending from the link 4. A bimetal plate 3 has a first end fixedly connected to the terminal plate 23 and a second end engaged with the engaging port 43 of the link 4. A second contact point 31 is connected to the second end of the bimetal plate 3.

Figure 3:
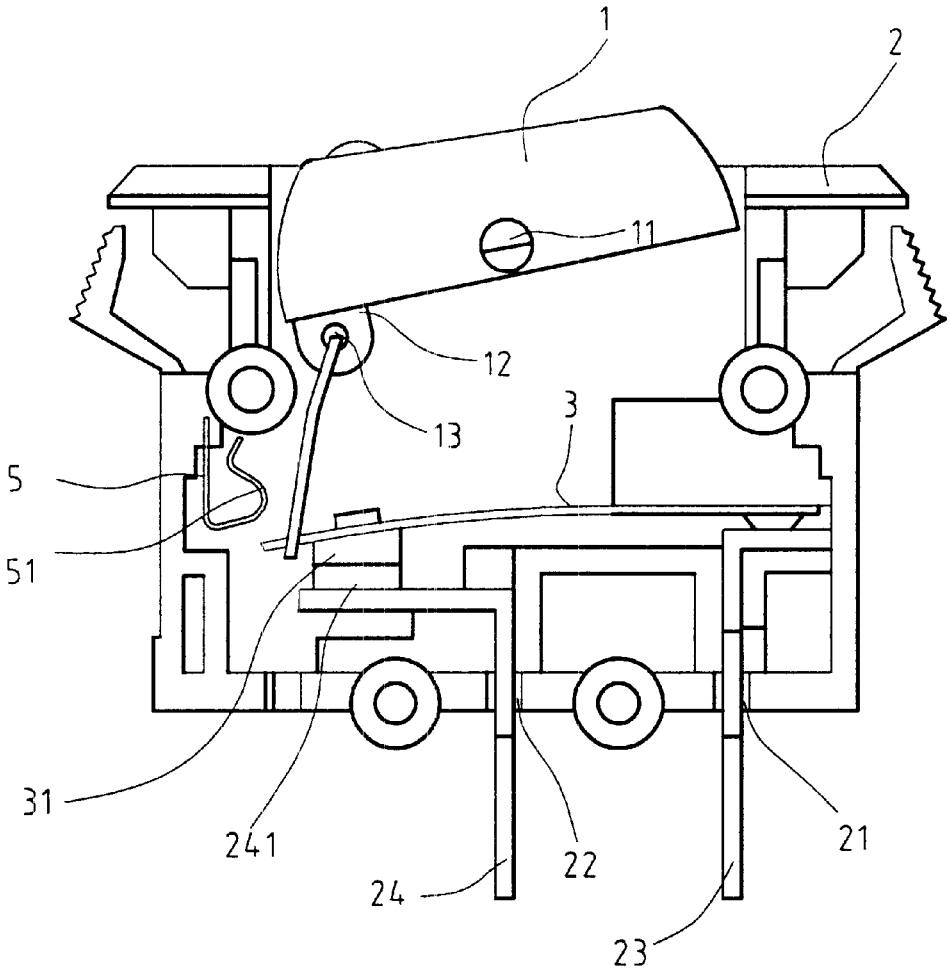
FIG. 3 is a side view to show the switch when the two contact points contact with each other by pushing the button.
Figure 4:
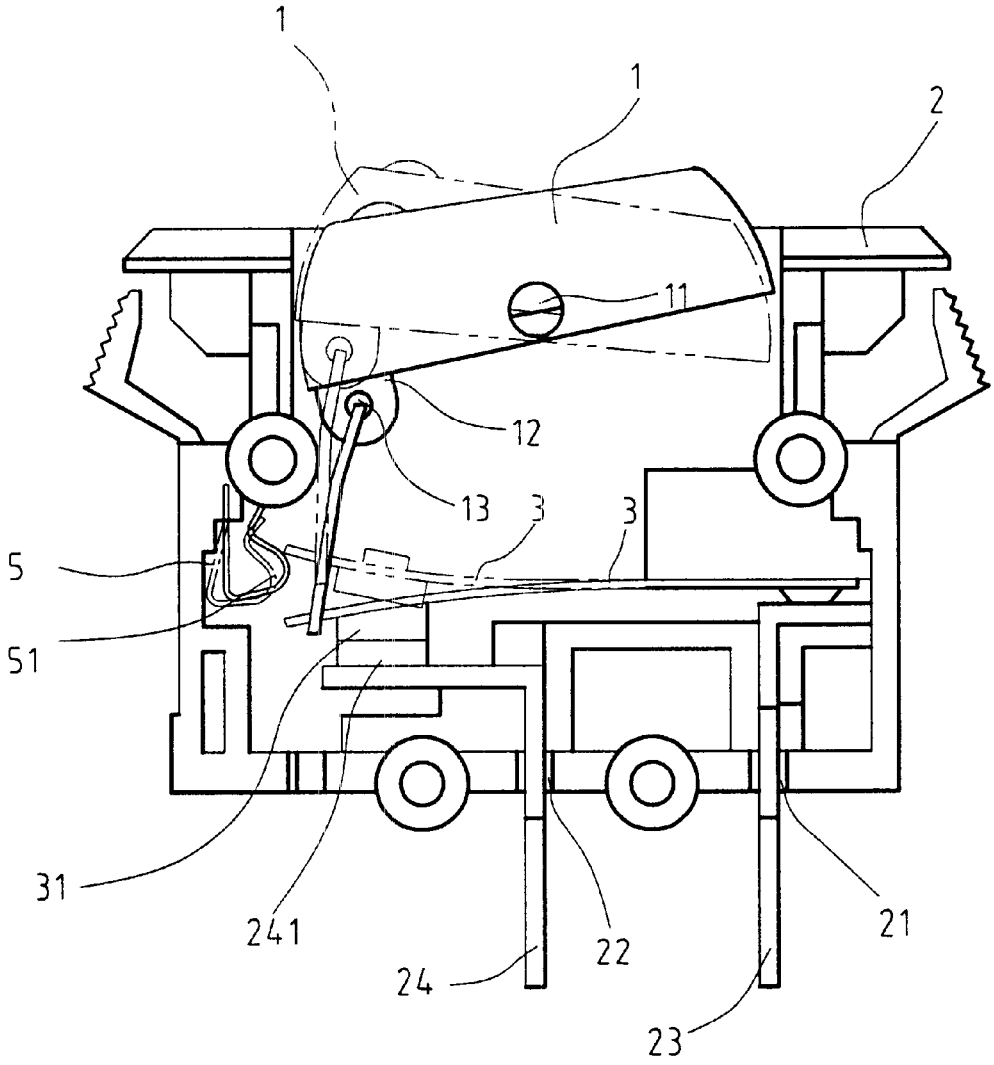
FIG. 4 is a side view to show the switch when the bimetal plate is deformed due to current overriding.

As shown in FIG. 3, when. the button 1 is pushed to lower the link 4, the first contact point 241 and the second contact point 31 are in contact with each other to close the circuit. As shown in FIG. 4, when the current overrides, the bimetal plate 3 is deformed and the second end of the bimetal plate 3 is deformed upward to push the link 4 and the button 1. The first contact point 241 and the second contact point 31 are separated from each other to open the circuit. During the deformation, the second end of the bimetal plate 3 moves over and pushes the protrusion 51 of the positioning member 5 till the second end of the bimetal plate 3 is moved to a position above the protrusion 51. By means of the protrusion 51, when the second end of the bimetal plate 3 is cool down, it will not contact the first contact point 241 until the user pushes the button 1 again.

While we have shown and described various embodiments in accordance with the present invention, it should be clear to those skilled in the art that further embodiments may be made without departing from the scope and spirit of the present invention.

What is claimed is:

1. A switch comprising:

a box;

a button pivotally connected to a top of said box;

first and second terminal plates respectively extending through a bottom of said box;

a link having a first end connected to one end of said button and a second end formed with an engaging port;

a bimetal plate having a first end fixedly connected to said first terminal plate and a second end engaged with said engaging port of said link; and a positioning member having a first end fixedly connected to said box and a second end formed with a protrusion, said second end of said bimetal plate being positioned on a first side of said protrusion for contacting said second terminal plate when said switch is closed, and said second end of said bimetal plate being moved over said protrusion to a second side of said protrusion when said switch is opened.

2. The switch as claimed in claim 1, wherein said positioning member is a U-shaped plate and a gap is defined between said first and second ends of said positioning member.

3. The switch as claimed in claim 1, said engaging port of said link comprising two rods extending from said second end of said link for retaining said second end of said bimetal plate between said two rods.

4. The switch as claimed in claim 1, further comprising a lug extending from said one end of said button, and said first end of said link being pivotally engaged with said lug.

5. The switch as claimed in claim 1, further comprising an engaging slit defined in said box, and said first end of said positioning member securely engaged with said engaging slit.

* * * * *